US010987731B1

(12) United States Patent
Robbins

(10) Patent No.: US 10,987,731 B1
(45) Date of Patent: Apr. 27, 2021

(54) DIE-CASTING PISTON, AND DIE-CASTING APPARATUS INCORPORATING SAME

(71) Applicant: Paul Henry Robbins, Markham (CA)

(72) Inventor: Paul Henry Robbins, Markham (CA)

(73) Assignee: Exco Technologies Limited, Markham (CA)

( * ) Notice: Subject to any disclaimer, the term of this patent is extended or adjusted under 35 U.S.C. 154(b) by 0 days.

(21) Appl. No.: 16/944,088

(22) Filed: Jul. 30, 2020

(51) Int. Cl.
*B22D 17/20* (2006.01)
*B22D 18/06* (2006.01)

(52) U.S. Cl.
CPC ..... *B22D 17/203* (2013.01); *B22D 18/06* (2013.01)

(58) Field of Classification Search
CPC ..... B22D 17/02; B22D 17/04; B22D 17/14; B22D 17/20; B22D 17/203; B22D 18/00; B22D 18/06; B22D 17/00; B22D 27/15
See application file for complete search history.

(56) References Cited

U.S. PATENT DOCUMENTS

2012/0111521 A1* 5/2012 Bullied ..... B22D 19/00 164/62
2018/0185910 A1* 7/2018 Robbins ..... B22D 17/2023

FOREIGN PATENT DOCUMENTS

JP 2006212696 A * 8/2006 ..... B22D 17/20

* cited by examiner

*Primary Examiner* — Kevin P Kerns
*Assistant Examiner* — Steven S Ha

(57) ABSTRACT

A piston of a die-casting apparatus includes: a piston tip having a generally cup-shaped body having an inner front face and an inner cylindrical surface, the inner front face having a plurality of grooves formed therein for conveying cooling fluid; and an inner piston carrier coupled to the piston tip, the carrier comprising an elongate forward portion matingly engaging the piston tip.

20 Claims, 14 Drawing Sheets

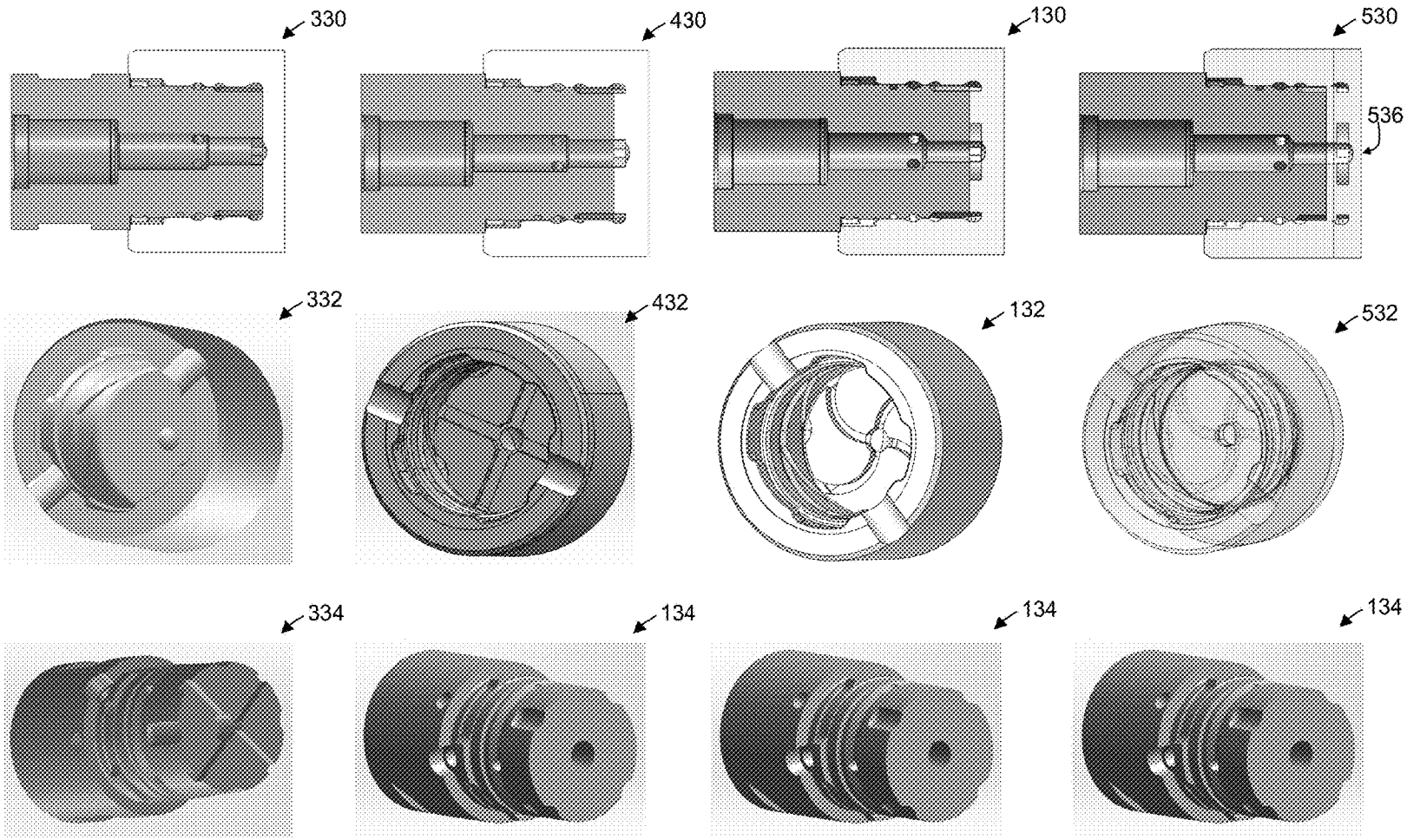
Figure 10A ("Piston A")
Figure 10B ("Piston B")
Figure 10C ("Piston C")
Figure 10D ("Piston D")

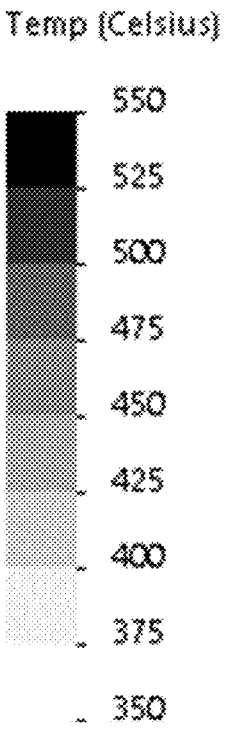
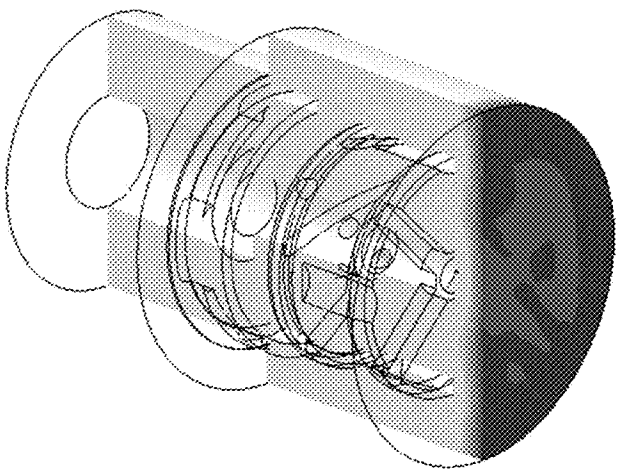
Figure 11A
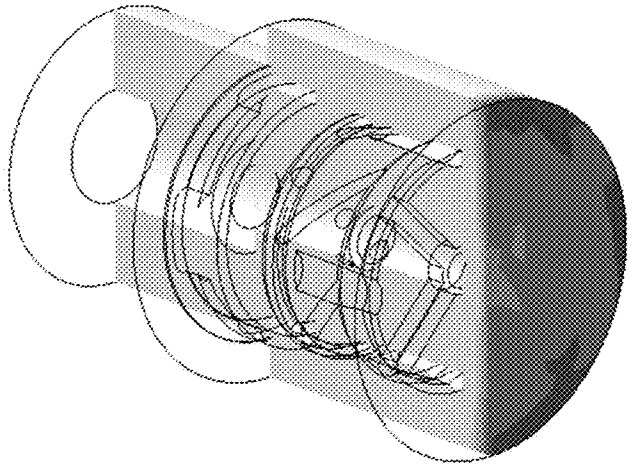
Figure 11B
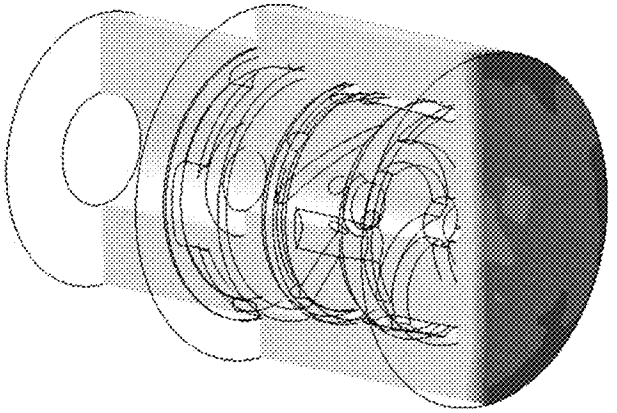
Figure 11C
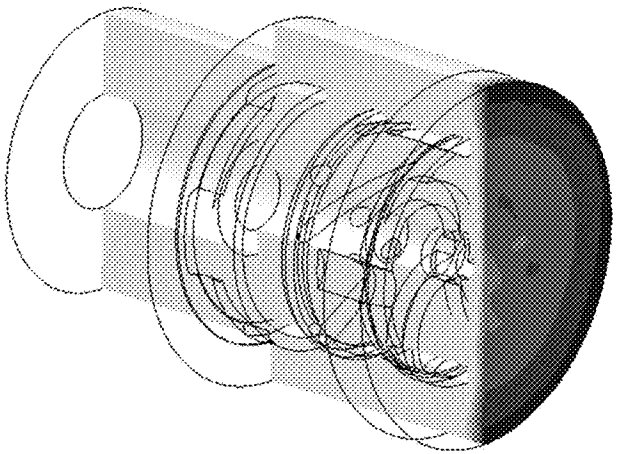
Figure 11D

DIE-CASTING PISTON, AND DIE-CASTING APPARATUS INCORPORATING SAME

FIELD

The subject disclosure relates generally to die-casting and in particular, to a die-casting piston and a die-casting apparatus incorporating the same.

BACKGROUND

In the field of automotive manufacturing, structural components that historically have been fabricated of steel, such as engine cradles, are increasingly being replaced with aluminum alloy castings. Such castings are typically large, convoluted, and relatively thin, and are required to meet the high quality standards of automotive manufacturing. In order to meet these requirements, vacuum-assisted die-casting is typically used to produce such castings.

Vacuum-assisted die-casting machines comprise a piston, sometimes referred to as a "plunger", that is advanced through a piston bore defined within a shot sleeve to push a volume of liquid metal into a mold cavity. Vacuum is applied to the piston bore to assist the flow of the liquid metal therethrough.

For example, FIG. 1 shows a portion of a prior art vacuum-assisted die-casting apparatus, which is generally indicated by reference numeral 20. Vacuum-assisted die-casting apparatus 20 comprises a piston that is moveable within a piston bore 22 defined within a shot sleeve 24 for pushing a volume of liquid metal (not shown) into a die-casting mold cavity (not shown) to form a casting. In the example shown, the piston is positioned at its starting position of the stroke, which is rearward of a port 26 through which the volume of liquid metal is introduced into the piston bore 22.

The piston comprises a piston tip 32 mounted on a forward end of a piston stem (not shown). The piston tip 32 has a front face 34 that is configured to contact the volume of liquid metal introduced into the piston bore 22 via port 26. In the example shown, the piston tip 32 has a wear ring 36 disposed on an outer surface thereof.

In operation, at the beginning of a stroke cycle, the piston is positioned at its starting position in the piston bore 22, and a volume of liquid metal is introduced into the piston bore 22 forward of the piston tip 32 via port 26. The piston is then moved forward through the piston bore 22 to push the volume of liquid metal into the mold cavity for forming a metal casting, and is moved rearward to its starting position to complete the stroke cycle. The cycle is repeated, as desired, to produce multiple metal castings.

Conventional die-casting piston tips are sometimes fabricated of a beryllium-copper alloys, owing to the high strength, high toughness, and high thermal conductivity of such alloys. However, beryllium-copper alloys are generally expensive. Additionally, beryllium is toxic and a known carcinogen, and therefore poses environmental and workplace safety issues. Other materials, such as certain steels having high strength and high toughness, have been proposed as materials from which die-casting materials may be fabricated. However, steel generally has much lower thermal conductivity than beryllium-copper alloys, and internal cooling would be required to prevent the steel from reaching high temperatures during operation.

Die-casting pistons having internal cooling have been described. For example, U.S. Pat. No. 8,136,574 to Müller et al. discloses a multi-piece piston for fixing to a high pressure side end of a piston rod running axially in a casting cylinder of a cold chamber casting machine. The piston comprises a piston crown forming a piston front face on the high pressure side and a piston body in the form of a bush connected to the piston crown on the low pressure side. Complementary bayonet locking means are provided for axial fixing of the piston to the end of the piston rod, on the piston crown and the end.

European Patent Application No. 2796226 to Taljat et al. describes a piston for die-casting comprising a piston body, which is a single element object, and a thermal regulation system integrated into or built inside the piston body, wherein the thermal regulation system includes a passageway enabling flow of fluid for temperature regulation of the piston. The piston with integrated cooling is generally produced as a single element product utilizing a particular manufacturing technology.

Improvements are generally desired. It is an object at least to provide a novel die-casting piston, and a die-casting apparatus incorporating the same.

SUMMARY OF THE INVENTION

Accordingly, in one aspect there is provided a piston of a die-casting apparatus, the piston comprising: a piston tip having a generally cup-shaped body having an inner front face and an inner cylindrical surface, the inner front face having a plurality of grooves formed therein for conveying cooling fluid; and an inner piston carrier coupled to the piston tip, the carrier comprising an elongate forward portion matingly engaging the piston tip.

The grooves may comprise curved grooves extending from a center of the inner front face to a periphery of the inner front face. Each curved groove may be formed in only one quarter of the inner front face. The grooves may further comprise a recess at the center of the front face.

The forward portion of the carrier may comprise: a generally planar front face comprising an aperture through which cooling fluid is delivered; and a cylindrical surface having a plurality of additional grooves formed therein. The additional grooves may comprise axial grooves extending from the front face of the carrier. The axial grooves may be formed in an intermediate surface of the cylindrical surface, the axial grooves extending a portion of a width of the intermediate surface. The intermediate surface may extend around a full revolution about the longitudinal axis of the carrier. The additional grooves may further comprise a circumferential groove extending around the cylindrical surface rearward of the intermediate surface. The circumferential groove may extend around a full revolution about the longitudinal axis of the carrier. The piston may further comprise at least one duct extending from the circumferential groove into an interior of the carrier.

The piston tip may be fabricated of AISI grade 4340 steel, AISI grade 300M steel, or AISI grade 4140 steel, or any compositional equivalent thereof. The carrier may be fabricated of AISI grade 4340 steel, AISI grade 300M steel, or AISI grade 4140 steel, or any compositional equivalent thereof.

In one embodiment, there is provided a die-casting apparatus comprising the piston. The die-casting apparatus may be a vacuum die-casting apparatus.

BRIEF DESCRIPTION OF THE DRAWINGS

Embodiments will now be described more fully with reference to the accompanying drawings in which:

FIGS. 10A to 10D are views of exemplary pistons, each comprising an exemplary piston tip and an exemplary piston carrier, used for computer simulations;

FIGS. 11A to 11D are graphical plots of calculated temperature as a function of position on the front face of the exemplary pistons of FIGS. 10A to 10D, respectively;

DETAILED DESCRIPTION OF THE EMBODIMENTS

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Figure 1:
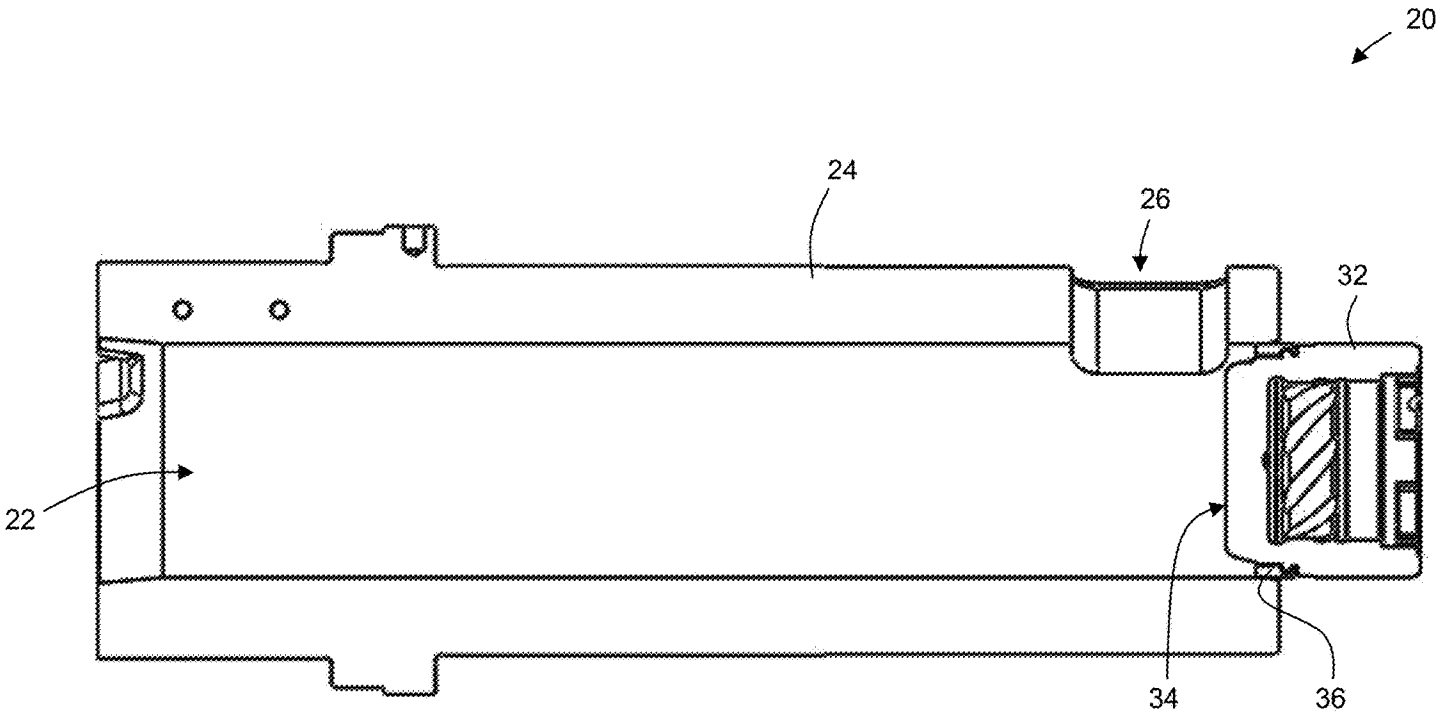
Figure 1 (PRIOR ART)
FIG. 1 is a sectional side view of a portion of a prior art die-casting apparatus, comprising a prior art piston tip.
Figure 2:
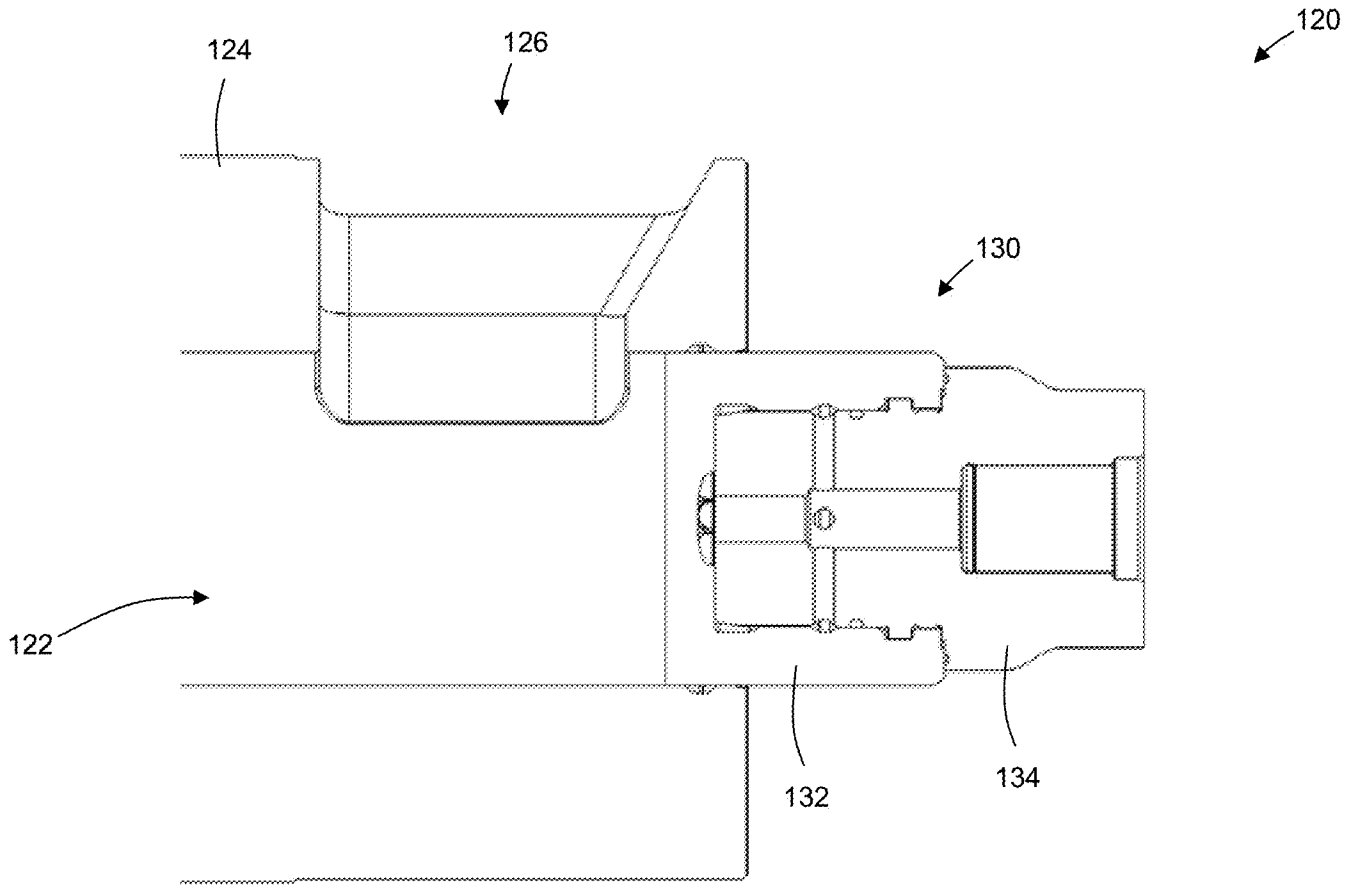
FIG. 2 is a sectional side view of a portion of a die-casting apparatus, comprising a piston.
Figure 3:
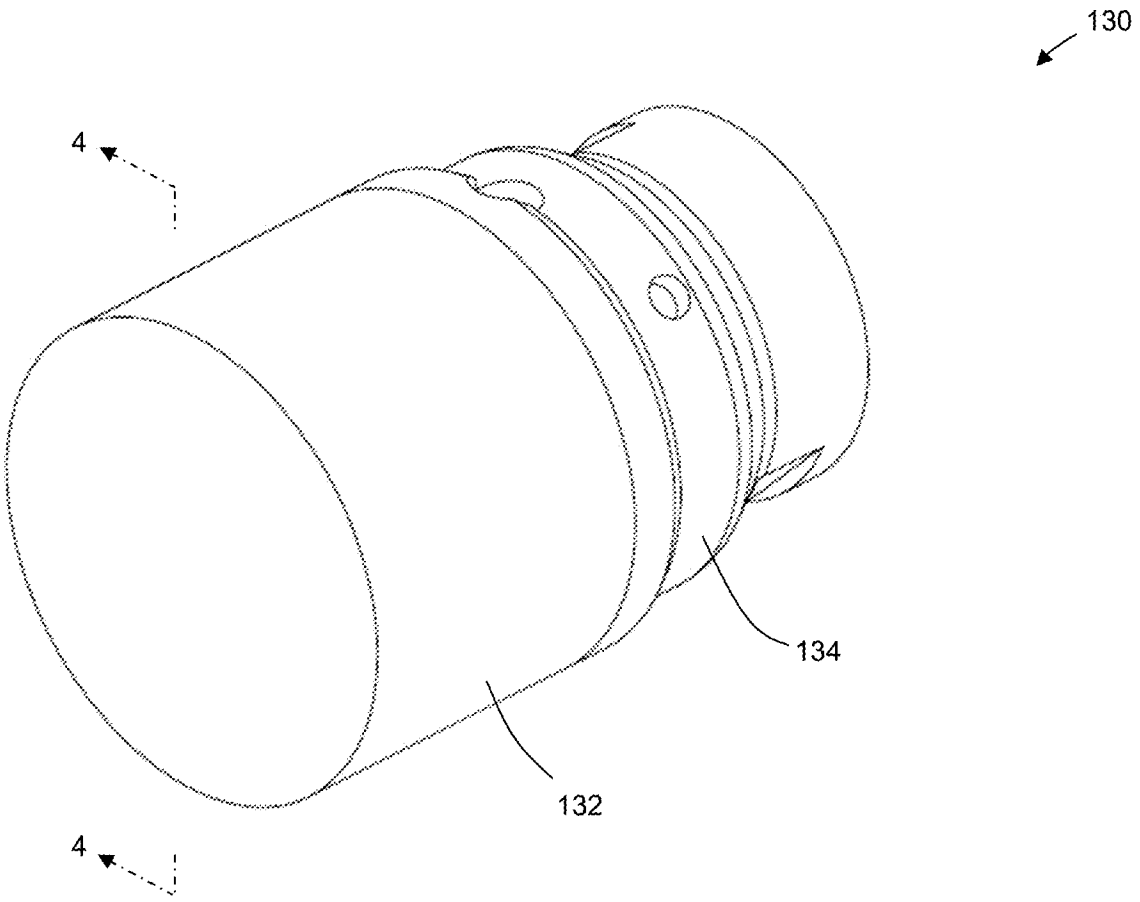
FIG. 3 is a perspective view of the piston of FIG. 2.

Turning now to FIG. 2, a portion of a vacuum-assisted die-casting apparatus is shown, and is generally indicated by reference numeral 120. Vacuum-assisted die-casting apparatus 120 comprises a piston 130 that is moveable within a piston bore 122 defined within a shot sleeve 124 for pushing a volume of liquid metal (not shown) into a die-casting mold cavity (not shown) to form a casting. The shot sleeve 124 comprises a port 126 through which the volume of liquid metal is introduced into the piston bore 122, and in the example shown, the piston 130 is positioned at its starting position of the stroke, which is rearward of the port 126.

The piston 130 may be better seen in FIGS. 3 to 9. The piston 130 is configured to be mounted on a forward end of a piston stem (not shown). The piston 130 comprises a piston tip 132, and an inner piston carrier 134 coupled to the piston tip 132.

The piston tip 132 comprises a generally cup-shaped body that has a front face 136 configured to contact the volume of liquid metal introduced into the piston bore 122, a rear surface 138 configured to abut the piston carrier 134, and a set of inwardly projecting lugs 140 adjacent the rear surface 138 that are configured to provide a bayonet-style connection with the carrier 134. In the embodiment shown, the front face 136 is generally planar. The piston tip 132 is fabricated of a tool steel that has a higher toughness and a higher yield strength than hot-worked tool steel, and in this embodiment the piston tip 132 is fabricated of AISI grade 4340 steel.

Figure 8:
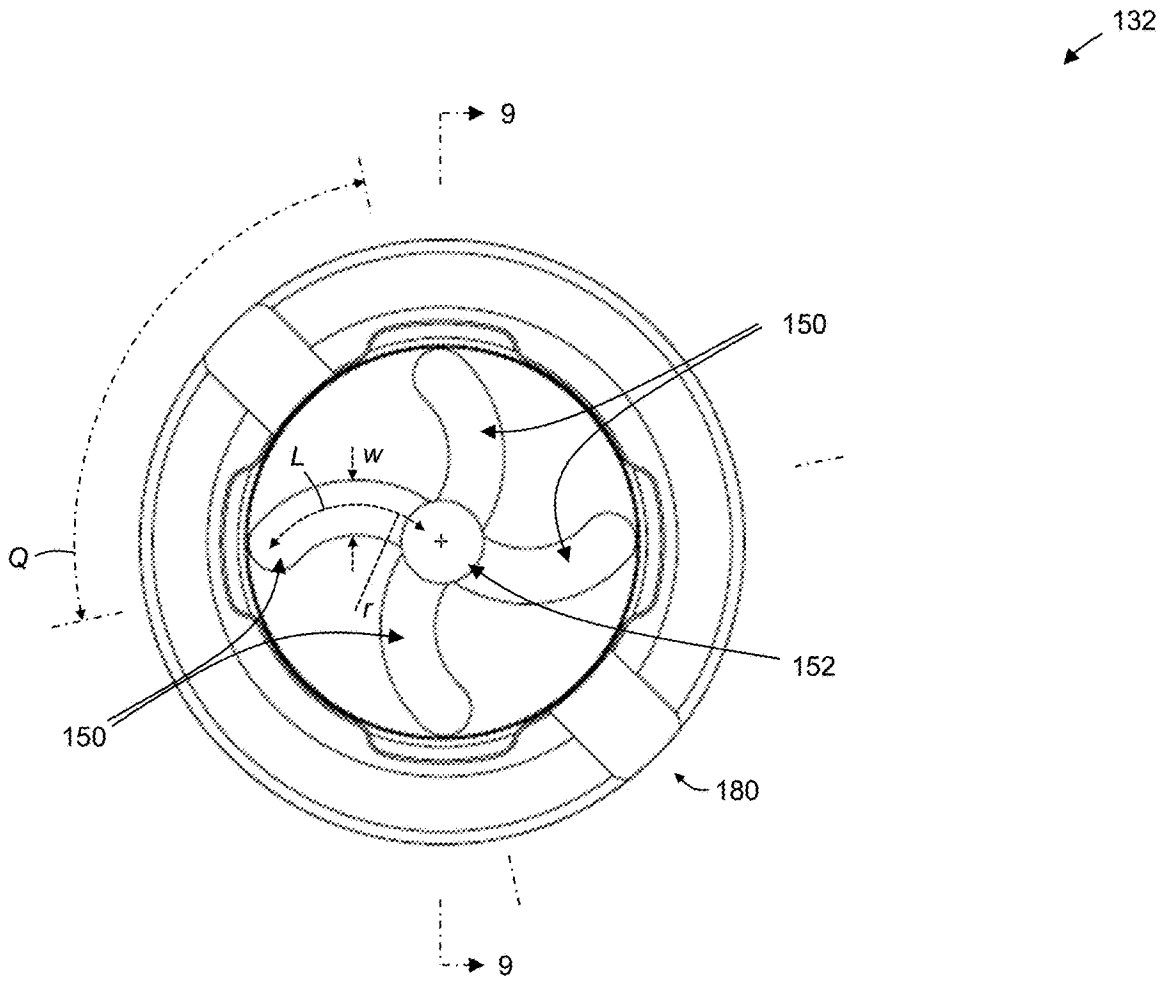
FIG. 8 is a rear end view of the piston tip.
Figure 9:
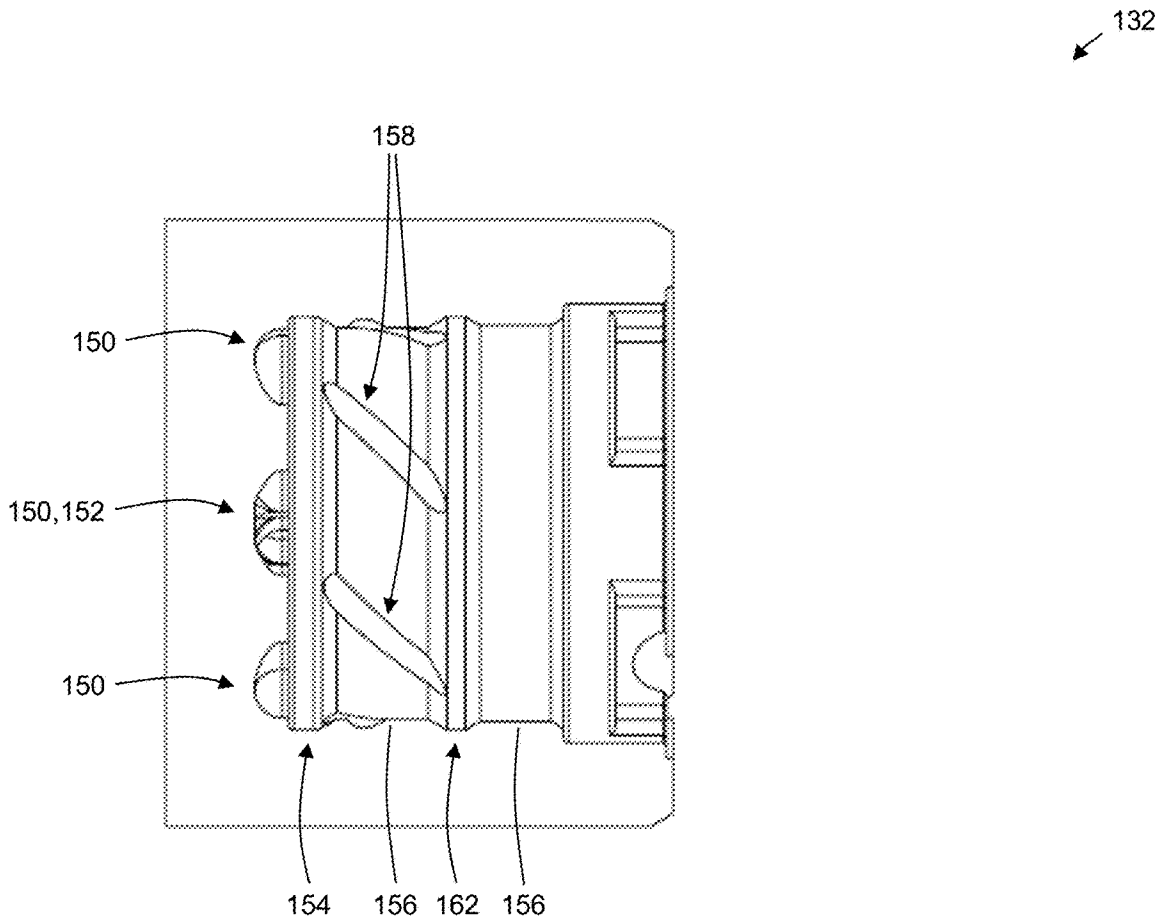
FIG. 9 is a sectional view of the piston tip of FIG. 8, taken along the indicated section line.

The piston tip 132 has an internal cavity defined by a forward inner surface 142 and a cylindrical inner surface 144. The forward inner surface 142 and the cylindrical inner surface 144 of the piston tip 132 have grooves formed therein, which cooperate with grooves formed in the carrier 134 to provide channels for conveying cooling fluid through the assembled piston 130 during operation. In this embodiment, the forward inner surface 142 has a plurality of curved grooves 150 formed therein. Each curved groove 150 has a width w, and extends from a central recess 152 along an arc length L having radius of curvature r, as shown in FIG. 8. In the embodiment shown, the forward inner surface 142 has four (4) curved grooves 150 formed therein, with each curved groove 150 occupying only a single respective quarter of the area, or "quadrant" Q, of the forward inner surface 142. It has been found by the inventor that extending the length L and/or or the radius of curvature r of the curved grooves such that each curved groove occupies more than one (1) quadrant Q results in excessive warming of the cooling fluid. The cylindrical inner surface 144 has a first circumferential groove 154 formed therein immediately adjacent the front face 142, a first inwardly projecting rib 156 rearward of the first circumferential groove 154 having a plurality of circumferentially-spaced inclined grooves 158 formed therein, a second circumferential groove 162 formed rearward of the first inwardly projecting rib 156, and a second inwardly projecting rib 164 rearward of the second circumferential groove 162, as shown in FIG. 9. As will be understood, each inclined groove 158 extends the width of the rib 156 in a direction that is inclined to the longitudinal axis A of the piston 130.

The carrier 134 comprises an elongate, generally cylindrical body that has a forward portion 168 shaped to matingly engage the internal cavity of the piston tip 132.

Rearward of the forward portion 168 is a collar 172 of larger diameter having a forward surface 174 configured to abut the rear surface 138 of the piston tip 132 in the assembled piston 130. A plurality of lugs 176 extend outwardly from the forward portion 168, and cooperate with the lugs 140 of the piston tip 132 to provide a bayonet-style connection, when the carrier 134 and the piston tip 132 are coupled and rotated into position to form the assembled piston 130. The collar 172 has a pair of notches 178 formed in the forward surface thereof, with each notch 178 being shaped to cooperate with a counterpart notch 180 formed in the rear surface 138 of the piston tip 132 to accommodate a respective locking screw 182, for preventing relative rotational movement of the piston tip 132 and the carrier 134 in the assembled piston 130. The carrier 134 is fabricated of a tool steel that has a higher toughness and a higher yield strength than hot-worked tool steel, and in this embodiment the carrier 134 is fabricated of AISI grade 4340 steel.

Figure 4:
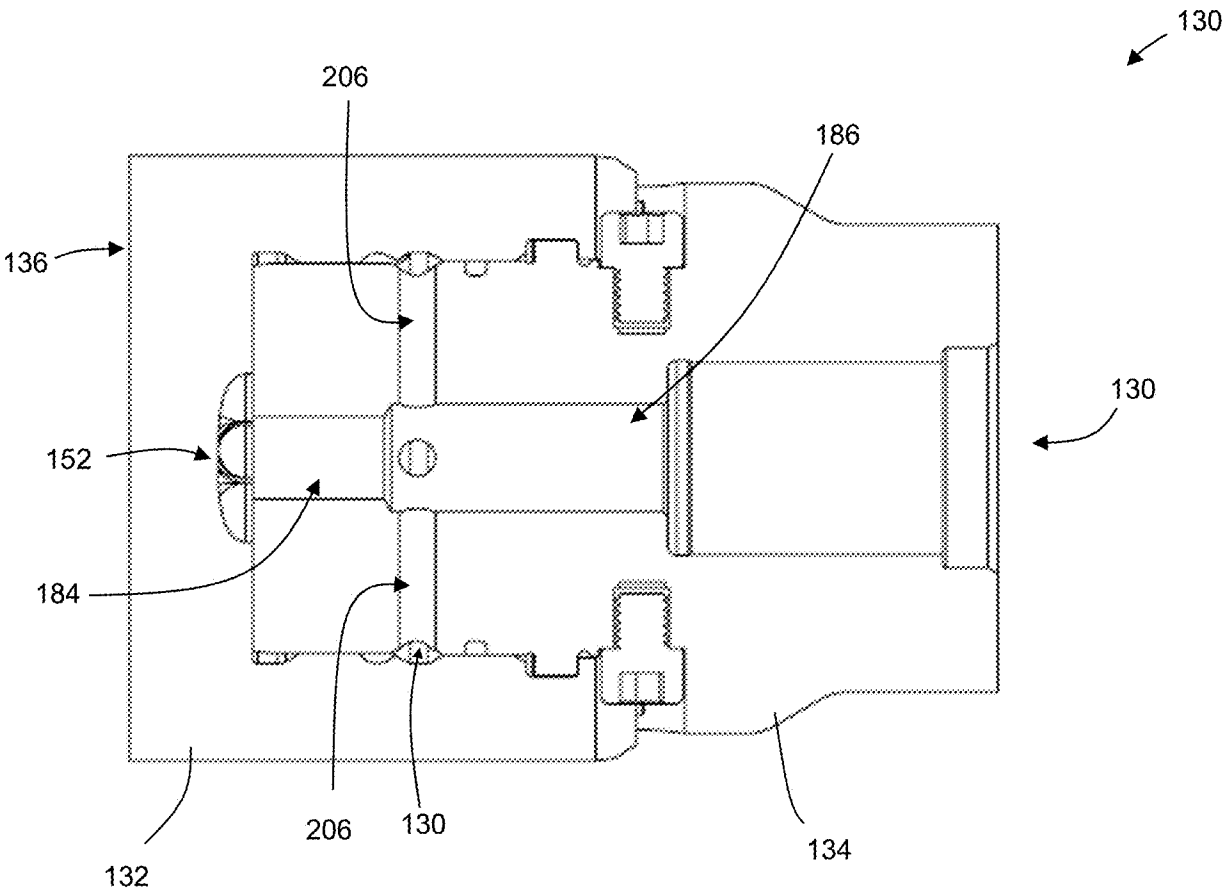
FIG. 4 is a sectional view of the piston of FIG. 3, taken along the indicated section line.

The carrier 134 has a plurality of internal conduits formed therein for conveying cooling fluid through the assembled piston 130 during operation. As shown in FIG. 4, the internal conduits comprise a forward internal conduit 184 for delivery of cooling fluid, and a rear internal conduit 186 for removal of cooling fluid. As will be understood, the cooling fluid is delivered to and removed from the carrier 134 through corresponding conduits (not shown) in the interior of the piston stem. In this embodiment, the cooling fluid is water, although another cooling fluid (such as air, for example) may alternatively be used.

Figure 5:
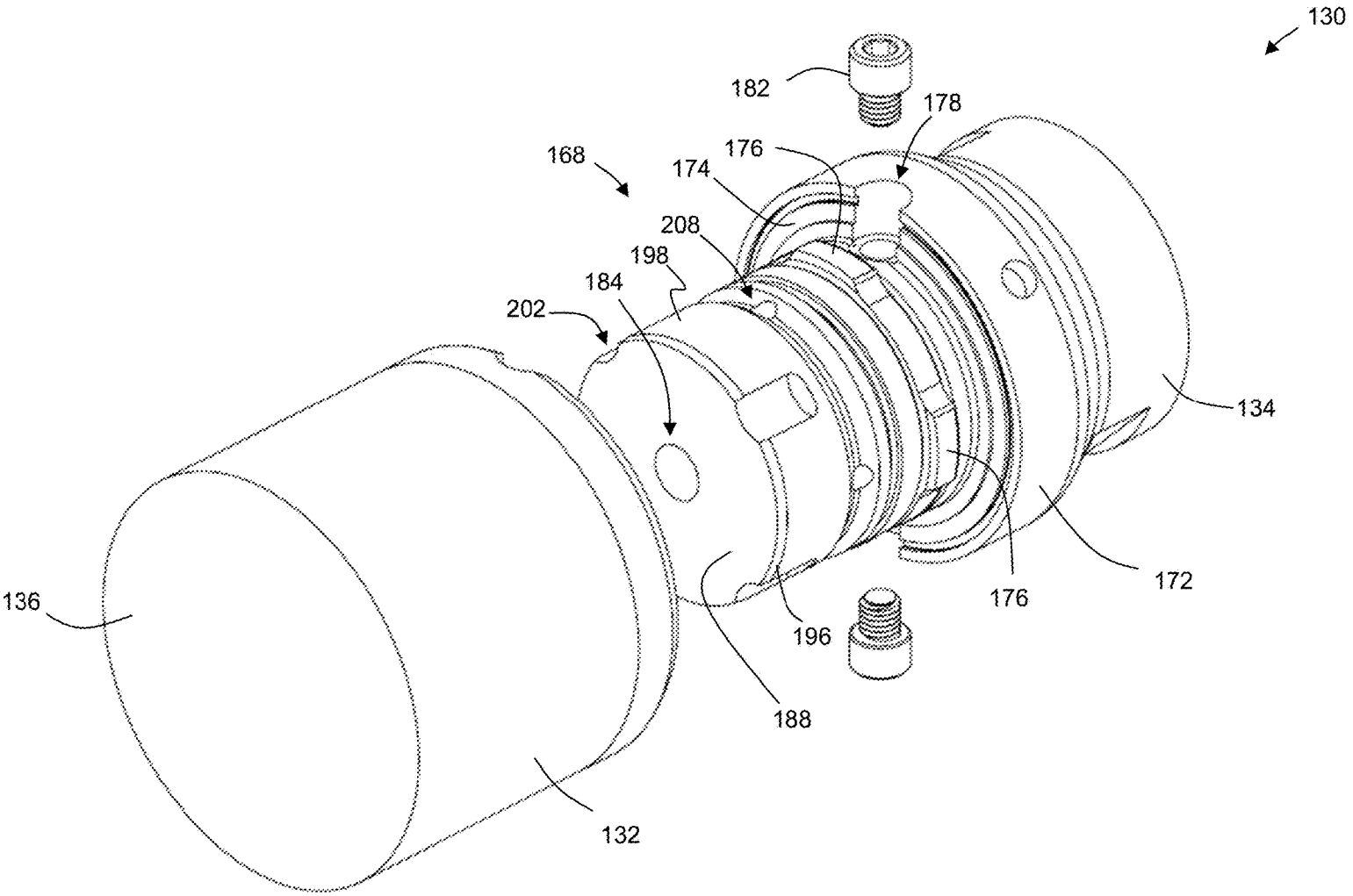
FIG. 5 is an exploded perspective view of the piston of FIG. 3.
Figure 6:
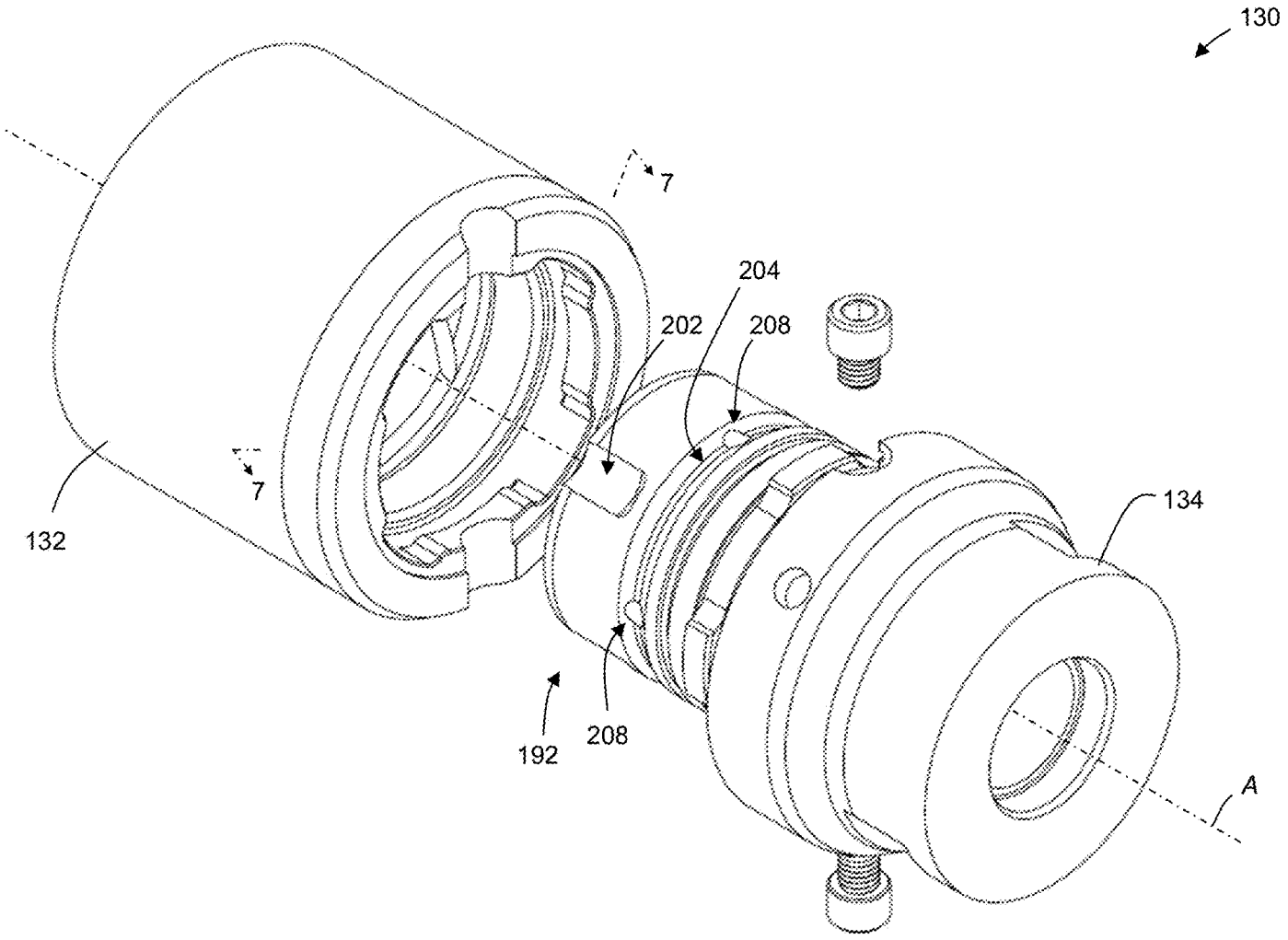
FIG. 6 is another exploded perspective view of the piston of FIG. 3.
Figure 7:
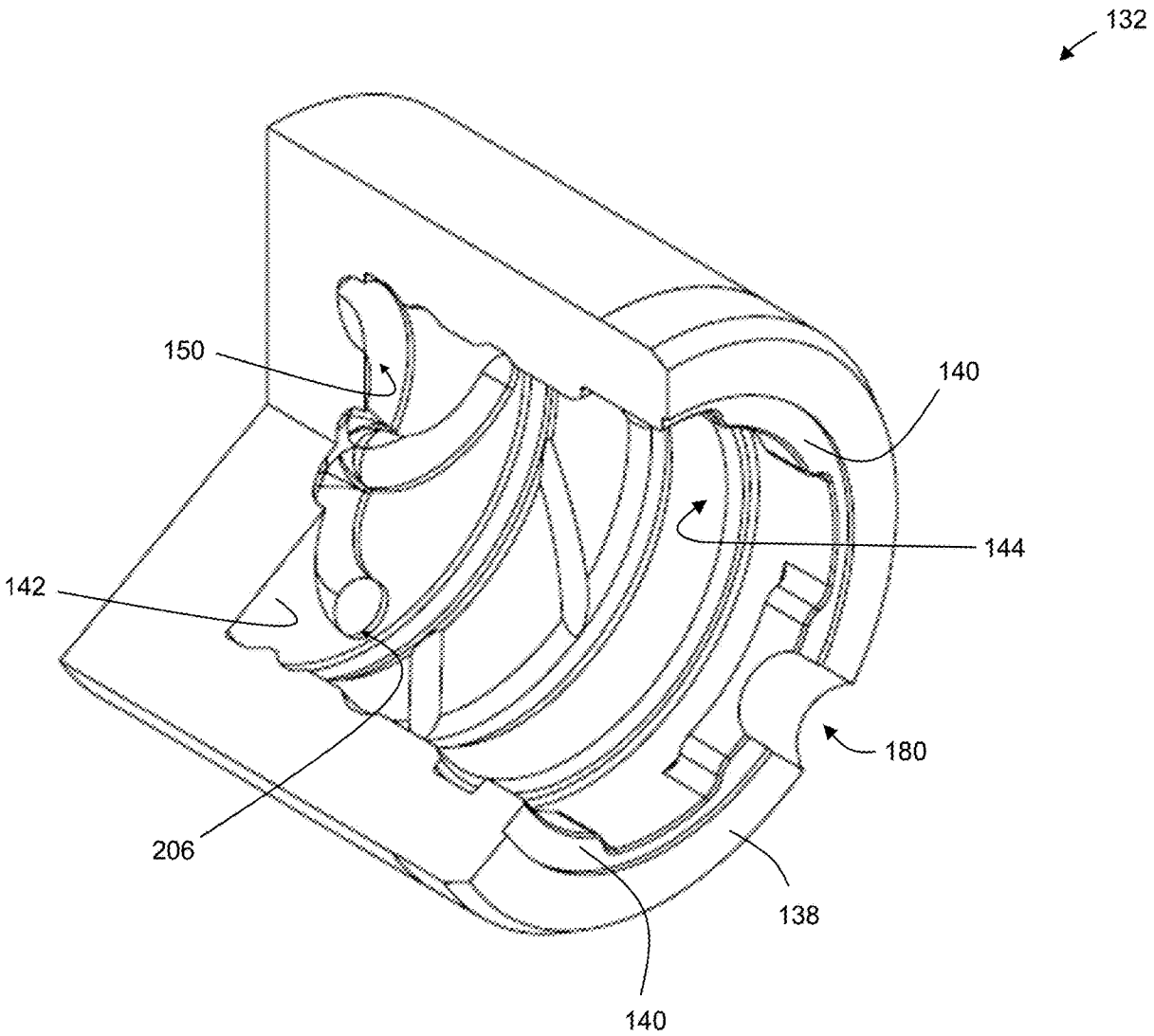
FIG. 7 is a sectional view of a piston tip forming part of the piston of FIG. 6, taken along the indicated section line.

The forward portion 168 of the carrier 134 has a generally planar front face 188, whose center is intersected by the forward internal conduit 184, and an outer cylindrical surface 192 rearward of the front face 188 in which a plurality of grooves are formed. The front face 188 and these grooves cooperate with the grooves formed in the internal cavity of the piston tip 132 to provide channels for conveying cooling fluid through the assembled piston 130 during operation. As shown in FIGS. 5 and 6, the cylindrical surface 192 has a forward bevel 196 formed adjacent the front face 188, an intermediate surface 198 rearward of the bevel 196 having a plurality of rearwardly-extending axial grooves 202 formed therein, and a circumferential groove 204 formed rearward of the intermediate surface 198. The axial grooves 202 extend from the front face 188 only a portion of the width of the intermediate surface 198, and in a direction that is parallel to the longitudinal axis A of the piston 130. As will be understood, the axial grooves 202 are positioned such that they generally coincide with the ends 206 of the curved grooves 150 formed in the piston tip 132, when the piston tip 132 and the carrier 134 are coupled and rotated into position to form the assembled piston 130. A plurality of ducts 208 are formed within the carrier 134, and extend from the circumferential groove 204 to the rear internal conduit 186.

In use, the assembled piston 130 is installed onto the piston stem and is inserted into the piston bore 122. At the beginning of a stroke cycle, the piston is positioned at its starting position in the piston bore 122, and a volume of liquid metal is introduced into the piston bore 122 forward of the piston 130 via port 126. The piston is then moved forward through the piston bore 122 to push the volume of liquid metal into the mold cavity for forming a metal casting, and is then moved rearward to its starting position to complete the stroke cycle. During the cycle, cooling fluid delivered by the piston stem is circulated through the interior of the piston 130 via, in general sequence, the internal conduit 184, the central recess 152 and the curved grooves 150, the first circumferential groove 154, the axial grooves 202, the inclined grooves 158, the second circumferential groove 162, the ducts 208, and the internal conduit 186, and is then subsequently removed by the piston stem, to cool the piston 130. The stroke cycle is repeated, as desired, to produce multiple metal castings.

As will be appreciated, positioning the grooves 150 on the piston tip 132, instead of on the front face of the carrier as in conventional pistons, advantageously allows cooling fluid to be delivered closer to the front face 156 of the piston tip 132. As will be understood, because the front face 156 contacts the volume of molten alloy during operation, the portion of the piston tip 132 near the front face 156 requires greater cooling. Positioning the grooves 150 on the piston tip 132 advantageously enables the piston 130 to be more effectively cooled, as compared to conventional pistons having grooves on the carrier.

As will be understood, the length of travel A of cooling fluid from the center of the central recess 152 to the end 206 of each curved groove 150 is $A=L+(2\times0.5w)$. As will be appreciated, by virtue of the non-linear shape of curved groove 150, the length of travel A is greater, and more circuitous, than merely the linear radius of the forward inner surface 142 of the piston tip 132. The greater length of travel advantageously increases the area of the piston tip 132 contacted by the cooling fluid, and therefore allows the piston 130 to be more effectively cooled as compared to conventional pistons.

As will be understood, limiting the length L of the curved grooves 150 such that each curved groove 150 occupies only a single respective quadrant Q of the area of the forward inner surface 142 advantageously avoids excessive warming of the cooling fluid during operation, which allows the piston to be more effectively cooled.

As will be appreciated, fabricating the piston tip 132 of tool steel having high toughness and high yield strength allows the portions of the piston 130 that contact or are in proximity with the liquid metal, but which do not contact the surface of the piston bore 122, to have increased resistance to thermal shock failure, as compared to conventional pistons having piston heads and bodies fabricated of other materials. As also be appreciated, the more effective cooling advantageously prevents the tool steel from reaching temperatures above or near the tempering temperature of the tool steel during operation. These features advantageously allow the piston 130 to be more durable and to provide a longer service life than conventional die-casting pistons.

As will be appreciated, the piston 130 is particularly well-suited for use in piston bores 122 having large diameters as, at normal die-casting operating temperatures, larger pistons thermally expand in the radial direction a greater absolute distance as compared to pistons used in bores having smaller diameter. As will be understood, the gap between the outer surface of the piston and the inner surface of the piston bore is the same for both larger and smaller pistons and, as a result, effective cooling is particularly important for pistons used in piston bores 122 having large diameter.

Although in the embodiment described above, the piston tip 132 has four (4) curved grooves 150 formed in the forward inner surface 142, in other embodiments, the piston tip 132 may alternatively have fewer or more than four (4) curved grooves formed therein.

Although in the embodiment described above, the piston tip and the carrier are fabricated of AISI grade 4340 steel, in other embodiments, one or both of the piston head and the body may alternatively be fabricated of AISI grade 300M steel or AISI grade 4140 steel, or of any non-AISI equivalent of AISI grade 4340, 300M or 4140 steel. In still other embodiments, one or both of the piston head and the body may alternatively be fabricated of any shock-resistant tool steel having a higher toughness and a higher yield strength than hot-worked tool steel.

In other embodiments, one or both of piston tip and the carrier may alternatively be fabricated of a tool steel having the following composition (expressed in weight percentage): from about 0.32% to about 0.48% carbon (C); from about 0.50% to about 1.50% chromium (Cr); from about 0.40% to about 1.30% manganese (Mn); and from 0.05% to about 0.90% molybdenum (Mo), the balance being mainly constituted by Iron (Fe), with optional other alloying elements and inevitable impurities. However, the composition of the tool steel is not limited to any specific, single composition. Preferably, the composition of the tool steel comprises from about 0.36% to about 0.48% C. More preferably, the composition of the tool steel comprises from about 0.37% to about 0.46% C. Preferably, the composition of the tool steel comprises from about 0.70% to about 1.10% Cr. More preferably, the composition of the tool steel comprises from about 0.70% to about 0.95% Cr. Preferably, the composition of the tool steel comprises from about 0.50% to about 1.10% Mn. More preferably, the composition of the tool steel comprises from about 0.60% to about 1.00% Mn. Preferably, the composition of the tool steel comprises from about 0.10% to about 0.80% Mo. More preferably, the composition of the tool steel comprises from about 0.15% to about 0.65% Mo. The tool steel may be that described, for example, in International PCT Application No. PCT/CA2017/051189 to Exco Technologies Limited, filed Oct. 5, 2017 and titled "TOOL STEEL COMPOSITION FOR COMPONENT OF DIE-CASTING APPARATUS OR OF EXTRUSION PRESS", the content of which is incorporated herein by reference in its entirety.

Although in the embodiments described above, both the piston tip and the carrier are fabricated of the material having higher toughness and a higher yield strength than hot-worked tool steel, in other embodiments, only the piston tip may alternatively be fabricated of the material having higher toughness and a higher yield strength than hot-worked tool steel. In still other embodiments, one or both of the piston tip and the carrier may alternatively be fabricated of another material, such as hot worked DIN 1.2367 grade steel, H13 grade steel, a beryllium-copper alloy, or still another suitable material.

The following example illustrates various applications of the above-described embodiments.

EXAMPLE

Three-dimensional (3-D) thermal computer simulations were carried out for exemplary pistons having different groove configurations to determine the effect of groove configuration on cooling efficiency. The simulations were carried out using SOLIDWORKS™ Professional software, by Dassault Systémes SE.

FIGS. 10A to 10D show four (4) exemplary pistons used for the simulations. Each piston comprises a piston tip and a piston carrier, each being fabricated of AISI grade 4340 steel. FIG. 10A shows a piston 330 comprising a piston tip 332 and a piston carrier 334, referred to hereafter as "Piston A". The piston tip 332 has a conventional forward inner surface that is generally planar, having only a central recess formed therein without other grooves. Otherwise, the piston tip 332 is identical to piston tip 132 described above. The carrier 334 has a conventional front face with linear, radial grooves formed therein, and a cylindrical surface that has notches where the linear radial grooves intersect; otherwise, the carrier 334 is identical to the carrier 134 described above.

FIG. 10B shows a piston 430 comprising a piston tip 432 and the piston carrier 134, referred to hereafter as "Piston B". The piston tip 432 has a forward inner surface having a plurality of linear, radial grooves formed therein extending from a central recess; otherwise, the piston tip 432 is identical to piston tip 132 described above. The carrier 134 has been described above.

FIG. 10C shows the piston 130 comprising the piston tip 132 and the piston carrier 134, described above, and which is referred to hereafter as "Piston C".

FIG. 10D shows a piston 530 comprising a piston tip 532 and the piston carrier 134, referred to hereafter as "Piston D". The piston tip 532 has an internal forward surface in which curved grooves and a central recess are formed, similar to those formed in the forward inner surface 142 of piston tip 132, but which is positioned closer to the front face 536 of the piston tip 532 as compared to piston tip 132. Additionally, the internal forward surface is covered by a layer of covering material defining the forward inner surface of the piston tip 532, and which has a central aperture formed therein that is aligned with and in fluid communication with the central recess formed in the internal forward surface. In this manner, the curved grooves, the central recess and the layer of covering material effectively define internal or "enclosed" curved channels within a forward portion of the piston tip 532 for providing internal cooling. The ends of the curved channels are in fluid communication with the cylindrical inner surface of the piston tip 532 via respective ducts. Otherwise, the piston tip 532 is identical to piston tip 132 described above. As will be understood, the piston tip 532 may be fabricated, for example, using an additive manufacturing technique. The carrier 134 has been described above.

A piston diameter of 5.5 inches was used for the simulations. The simulations were carried out for several successive stroke cycles, with each stroke cycle comprising 30 seconds of contact between the piston and a volume of molten aluminum A356 alloy having an initial temperature of 670° C. and a length of 2", followed by 30 seconds of non-contact. Water having a temperature of 27° C. was circulated continuously through each piston during the stroke cycle. The initial temperature of the piston at the beginning of the first cycle was 50° C. The simulations involved time-dependent calculations to allow the thermal history of both the piston and the aluminum alloy to be determined. The simulations considered the latent heat of solidification to account for at least partial solidification of the alloy during each stroke cycle.

Table 1 shows the average, minimum and maximum calculated temperatures on the front face of the piston tip at various times during the first two (2) stroke cycles, for each of the pistons shown in FIGS. 10A to 10D:

TABLE I

| Time | Temperature (° C.) Average (Minimum-Maximum) | | | |
|---|---|---|---|---|
| (s) | Piston A | Piston B | Piston C | Piston D |
| 30 | 467 (453-483) | 459 (434-474) | 458 (432-474) | 476 (429-497) |
| 60 | 150 (115-169) | 130 (89-158) | 128 (84-156) | 103 (40-154) |
| 90 | 477 (459-490) | 466 (437-483) | 465 (434-483) | 480 (430-504) |
| 120 | 156 (118-178) | 141 (94-166) | 132 (85-163) | 106 (40-161) |

As will be understood, the times t=30 s, t=60 s, t=90 s and t=120 s correspond to the ends of the first contact portion, the first cooling (i.e. non-contact) portion, the second contact portion, and the second cooling portion, respectively. As can be seen, the lowest average calculated temperature at the end of each contact portion (i.e. at t=30 s and t=90 s) was observed for Piston C, as compared to Pistons A, B and D. The results indicate that the groove configuration of Piston C provides more effective cooling of the front face, as compared to the groove configurations of Pistons A, B and D.

FIGS. 11A to 11D are graphical plots of calculated temperature as a function of position on the front face at t=90 s for the four (4) pistons shown in FIGS. 10A to 10D, respectively. For all configurations, the calculated temperature is lowest at the center of the front face, and highest at the periphery. However, as can be seen, the calculated temperature distribution across the front face is observably more uniform for Piston C, as compared to Pistons A, B and D.

Figure 12A:
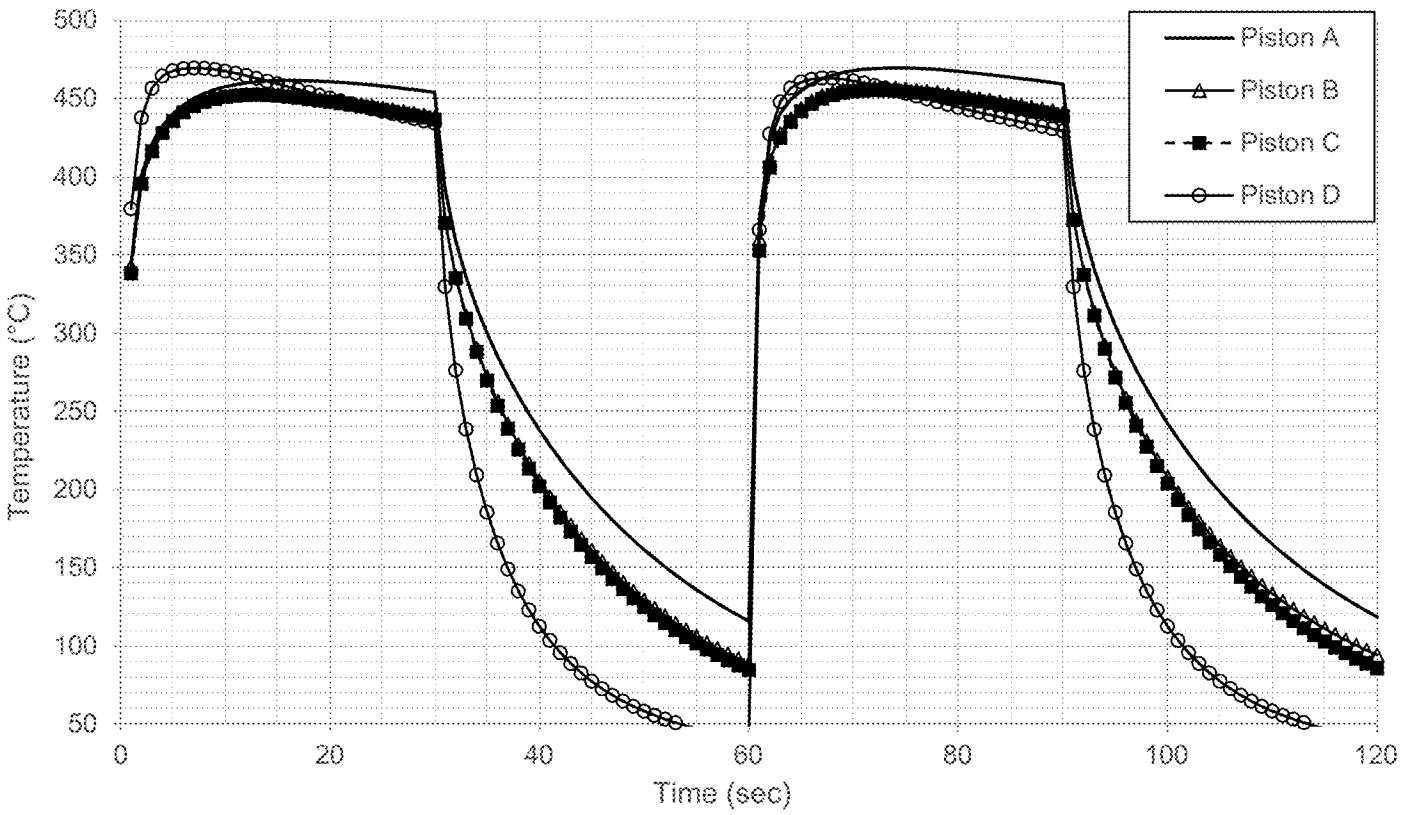
FIGS. 12A and 12B are graphical plots of calculated temperature on the center of the front face as a function of time, for the exemplary pistons of FIGS. 10A to 10D, respectively.
Figure 12B:
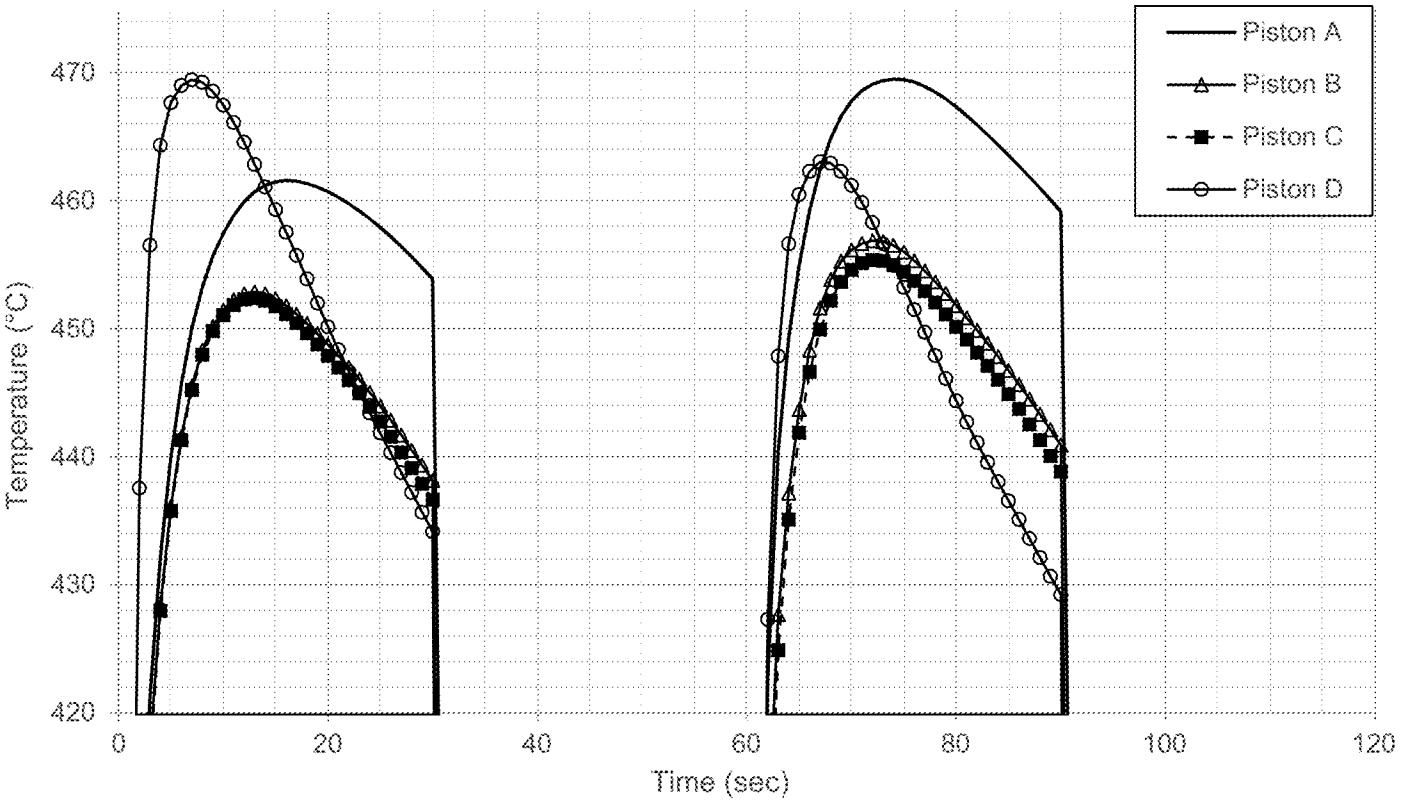

FIGS. 12A and 12B are graphical plots of calculated temperature at the center of the front face as a function of time, for the four (4) pistons shown in FIGS. 10A to 10D. As can be seen, the maximum calculated temperature during any stroke cycle is lowest for Piston C (e.g. T=455° C. at t=72 s), as compared to Piston B (T=457° C. at t=72 s), Piston D (T=463° C. at t=67 s) and Piston A (T=469° C. at t=74 s). These results indicate that the groove configuration of Piston C provides more effective cooling at the center of the front face, as compared to the groove configurations of Pistons A, B and D. Additionally, the difference in maximum calculated temperature between Piston C and Pistons A, B and D was observed to increase as the number of stroke cycles increased.

Figure 13:
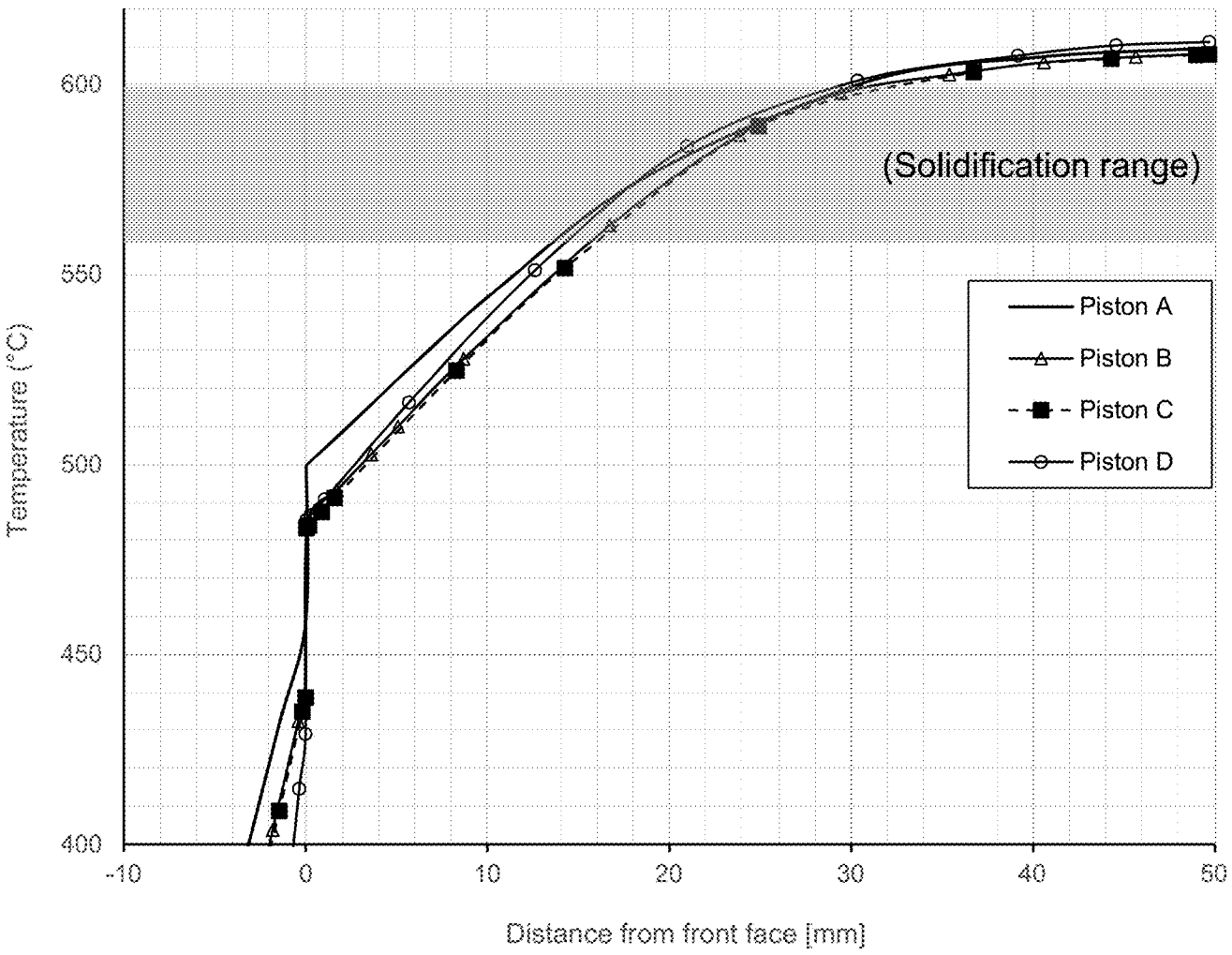
FIG. 13 is a graphical plot of calculated temperature as a function of position along the longitudinal axis of the piston, for the exemplary pistons of FIGS. 10A to 10D, respectively.

FIG. 13 is a graphical plot of calculated temperature as a function of distance along the longitudinal axis of the piston at the end of the contact portion of the second cycle (i.e. at t=90 s), for the four (4) pistons shown in FIGS. 10A to 10D. In this plot, distance, d, is relative to the front face of the piston tip, so that a value of zero (d=0) is on the front face (specifically, at the center of the front face), a negative value (d<0) is inside the piston tip, and a positive value (d>0) is inside the volume of aluminum alloy being pushed by the front face. As will be understood, the solidification zone of A365 alloy ranges from about 560° C. to about 600° C. and, as a result, at the end of the contact portion of a stroke cycle, a portion of the volume of the aluminum alloy ahead of piston tip has begun to solidify.

As can be seen, although the temperature on the front face (d=0) is lowest for Piston D (T=430° C. at t=90 s, as also indicated in Table I), the groove configuration of Piston C more effectively cools the volume of aluminum alloy, as evidenced by the distance ahead of the piston tip at which the aluminum alloy has been cooled to 600° C. These results indicate that the groove configuration of Piston C provides better cooling of the aluminum alloy, and therefore a greater amount of partial solidification of the aluminum alloy, as compared to the groove configurations of Pistons A, B and D.

Although embodiments have been described above with reference to the accompanying drawings, those of skill in the art will appreciate that variations and modifications may be made without departing from the scope thereof as defined by the appended claims.

What is claimed is:

1. A piston of a die-casting apparatus, the piston comprising:

a piston tip having a generally cup-shaped body having an inner front face and an inner cylindrical surface, the inner front face having a plurality of grooves formed therein for conveying cooling fluid; and an inner piston carrier coupled to the piston tip, the carrier comprising an elongate forward portion matingly engaging the piston tip, wherein the grooves comprise curved grooves extending from a center of the inner front face to a periphery of the inner front face.

2. The piston of claim 1, wherein each curved groove extends within only one quarter of the inner front face.

3. The piston of claim 1, wherein the grooves further comprise a recess at the center of the front face.

4. The piston of claim 1, wherein the forward portion of the carrier comprises:

a generally planar front face comprising an aperture through which cooling fluid is delivered; and a cylindrical surface having a plurality of additional grooves formed therein.

5. The piston of claim 4, wherein the additional grooves comprise axial grooves extending from the front face of the carrier.

6. The piston of claim 5, wherein the axial grooves are formed in an intermediate surface of the cylindrical surface, the axial grooves extending a portion of a width of the intermediate surface.

7. The piston of claim 6, wherein the intermediate surface extends around a full revolution about the longitudinal axis of the carrier.

8. The piston of claim 6, wherein the additional grooves further comprise:

a circumferential groove extending around the cylindrical surface rearward of the intermediate surface.

9. The piston of claim 8, wherein the circumferential groove extends around a full revolution about the longitudinal axis of the carrier.

10. The piston of claim 8, further comprising at least one duct extending from the circumferential groove into an interior of the carrier.

11. The piston of claim 1, wherein the piston tip is fabricated of AISI grade 4340 steel, AISI grade 300M steel, or AISI grade 4140 steel, or any compositional equivalent thereof.

12. The piston of claim 1, wherein the carrier is fabricated of AISI grade 4340 steel, AISI grade 300M steel, or AISI grade 4140 steel, or any compositional equivalent thereof.

13. A die-casting apparatus comprising the piston of claim 1.

14. The die-casting apparatus of claim 4, wherein the die-casting apparatus is a vacuum die-casting apparatus.

15. A piston of a die-casting apparatus, the piston comprising:

a piston tip having a generally cup-shaped body having an inner front face and an inner cylindrical surface, the inner front face having a plurality of grooves formed therein for conveying cooling fluid; and an inner piston carrier coupled to the piston tip, the carrier comprising an elongate forward portion matingly engaging the piston tip, wherein the forward portion of the carrier comprises:

a generally planar front face comprising an aperture through which cooling fluid is delivered; and a cylindrical surface having a plurality of additional grooves formed therein, wherein the additional grooves comprise axial grooves extending from the front face of the carrier.

16. The piston of claim 15, wherein the axial grooves are formed in an intermediate surface of the cylindrical surface, the axial grooves extending a portion of a width of the intermediate surface.

17. The piston of claim 16, wherein the intermediate surface extends around a full revolution about the longitudinal axis of the carrier.

18. The piston of claim 16, wherein the additional grooves further comprise:

a circumferential groove extending around the cylindrical surface rearward of the intermediate surface.

19. The piston of claim 18, wherein the circumferential groove extends around a full revolution about the longitudinal axis of the carrier.

20. The piston of claim 18, further comprising at least one duct extending from the circumferential groove into an interior of the carrier.

* * * * *